US008388064B2

(12) United States Patent
Bertolini et al.

(10) Patent No.: US 8,388,064 B2
(45) Date of Patent: Mar. 5, 2013

(54) STACKABLE CHAIR WITH FLEXIBLE BACK

(75) Inventors: James Bertolini, Chino, CA (US); Bruce William Prock, Chino, CA (US)

(73) Assignee: Bertolini Corporation, Chino, CA (US)

( * ) Notice: Subject to any disclaimer, the term of this patent is extended or adjusted under 35 U.S.C. 154(b) by 352 days.

(21) Appl. No.: 12/771,997

(22) Filed: Apr. 30, 2010

(65) Prior Publication Data

US 2011/0266847 A1 Nov. 3, 2011

(51) Int. Cl.
*A47C 3/00* (2006.01)

(52) U.S. Cl. ..... 297/299; 297/285; 297/301.5

(58) Field of Classification Search ..... 297/297, 297/298, 299, 285, 301.3, 301.5
See application file for complete search history.

(56) References Cited

U.S. PATENT DOCUMENTS 5,039,163 A * 8/1991 Tolleson ..... 297/297
5,100,201 A * 3/1992 Becker et al. ..... 297/301.3
5,524,963 A 6/1996 Barile
D401,453 S 11/1998 Holt
5,904,397 A * 5/1999 Fismen ..... 297/291
D413,029 S 8/1999 Caruso
D413,207 S 8/1999 Caruso
D417,567 S 12/1999 Barile
6,088,877 A 7/2000 Swy et al.
D431,385 S 10/2000 Barile et al.
D431,725 S 10/2000 Barile et al.
D432,805 S 10/2000 Smith
D433,587 S 11/2000 Barile
D433,836 S 11/2000 Barile, Sr.
D434,242 S 11/2000 Swy et al.
6,174,029 B1 1/2001 Swy
6,206,469 B1 3/2001 Caruso et al.
D440,435 S 4/2001 Ware
6,234,571 B1 5/2001 Atkins et al.
D443,995 S 6/2001 Caruso et al.
D445,612 S 7/2001 Swy
6,279,991 B1 8/2001 Atkins et al.
6,305,742 B1 10/2001 Spendlove et al.
6,338,528 B1 1/2002 Lohness et al.
6,345,863 B1 2/2002 Laws et al.
D454,271 S 3/2002 Swy et al.
D454,452 S 3/2002 Swy et al.
D454,736 S 3/2002 Swy et al.
D455,031 S 4/2002 Swy et al.
D456,190 S 4/2002 Swy et al.
D457,022 S 5/2002 Swy et al.
6,406,094 B2 6/2002 Lohness et al.
6,406,096 B1 6/2002 Barile, Sr.
6,422,645 B1 7/2002 Smith et al.
D461,078 S 8/2002 Swy et al.
6,471,293 B2 * 10/2002 Ware et al. ..... 297/239
6,612,654 B2 9/2003 Laws et al.
D484,780 S 1/2004 Barile, Sr.
D485,085 S 1/2004 Swy et al.
6,679,551 B2 1/2004 Ware et al.
D486,677 S 2/2004 Barile, Sr.
D486,984 S 2/2004 Barile, Jr. et al.
D486,985 S 2/2004 Barile, Sr.
D491,383 S 6/2004 Swy et al.

(Continued)

*Primary Examiner* — David Dunn
*Assistant Examiner* — David E Allred

(57) ABSTRACT

A stackable chair having a back member may flex to allow for improved user comfort. An inline spring-to-frame configuration with a pair of spring members reinforced by steel plates on the top and bottom of each end of each spring is attached to the underside of the left and right members of the seat support frame. The spring-to-frame configuration may allow the back support frame to flex relative to the seat support frame.

20 Claims, 3 Drawing Sheets

U.S. PATENT DOCUMENTS

| | | | |
|---|---|---|---|
| D492,145 | S | 6/2004 | Barile, Sr. |
| 6,749,259 | B2 | 6/2004 | Ware et al. |
| D492,495 | S | 7/2004 | Barile, Jr. et al. |
| 6,779,846 | B2 | 8/2004 | Spendlove et al. |
| D497,490 | S | 10/2004 | Socha, Jr. et al. |
| D497,729 | S | 11/2004 | Peitz et al. |
| D498,072 | S | 11/2004 | Barile et al. |
| D498,366 | S | 11/2004 | Barile, Jr. et al. |
| D498,603 | S | 11/2004 | Swy et al. |
| 6,820,934 | B2 | 11/2004 | Ware et al. |
| 6,837,542 | B2 | 1/2005 | Barile, Jr. et al. |
| D502,030 | S | 2/2005 | Barile, Sr. |
| D502,331 | S | 3/2005 | Socha, Jr. et al. |
| 6,860,556 | B2 | 3/2005 | Barile, Sr. et al. |
| D503,573 | S | 4/2005 | Swy et al. |
| 6,896,327 | B1 | 5/2005 | Barile, Sr. |
| D509,084 | S | 9/2005 | Barile, Jr. |
| D513,456 | S | 1/2006 | Smith |
| 7,014,268 | B2 | 3/2006 | Socha, Jr. et al. |
| 7,021,712 | B2 | 4/2006 | Spendlove et al. |
| D521,264 | S | 5/2006 | Ware et al. |
| 7,052,083 | B2 | 5/2006 | Peitz et al. |
| D522,776 | S | 6/2006 | Williams et al. |
| D528,813 | S | 9/2006 | Sienkowski et al. |
| D544,227 | S | 6/2007 | Bartlmae |
| D544,228 | S | 6/2007 | Bartlmae |
| D544,229 | S | 6/2007 | Bartlmae |
| D544,236 | S | 6/2007 | Swy et al. |
| D576,817 | S | 9/2008 | Sienkowski |
| D578,788 | S | 10/2008 | Ware |
| D588,826 | S | 3/2009 | Ricchio |
| 7,552,968 | B2 | 6/2009 | Smith et al. |
| 7,571,960 | B2 | 8/2009 | Williams et al. |
| D599,127 | S | 9/2009 | Smith |
| 7,591,511 | B2 | 9/2009 | Smith et al. |
| D604,070 | S | 11/2009 | McElmurry |
| 7,654,617 | B2 | 2/2010 | Farnsworth |
| D624,327 | S | 9/2010 | Swy |
| D629,223 | S | 12/2010 | Swy |
| D629,629 | S | 12/2010 | Swy |
| D629,630 | S | 12/2010 | Saul |
| D635,790 | S | 4/2011 | Saul |
| D646,073 | S | 10/2011 | Socha, Jr. |
| D646,095 | S | 10/2011 | Langbord et al. |
| D646,096 | S | 10/2011 | Langbord et al. |
| D646,097 | S | 10/2011 | Langbord et al. |
| 8,029,059 | B2 | 10/2011 | Smith et al. |
| 8,033,598 | B2 | 10/2011 | Smith et al. |
| 8,033,612 | B2 | 10/2011 | Smith et al. |
| 8,038,221 | B2 | 10/2011 | Smith et al. |
| D648,554 | S | 11/2011 | Smith |
| D650,196 | S | 12/2011 | Swy et al. |
| D655,103 | S | 3/2012 | Barile |
| 8,152,235 | B2 | 4/2012 | McElmurry |
| 8,152,237 | B2 | 4/2012 | Saul |
| D660,611 | S | 5/2012 | Barile |
| D660,612 | S | 5/2012 | Smith |
| D663,974 | S | 7/2012 | Swy |
| 2003/0042777 | A1* | 3/2003 | Ware et al. ..... 297/285 |
| 2004/0080199 | A1* | 4/2004 | Ware et al. ..... 297/285 |
| 2010/0156155 | A1 | 6/2010 | Smith |
| 2010/0156156 | A1 | 6/2010 | Smith |
| 2010/0181807 | A1 | 7/2010 | Smith |
| 2012/0126588 | A1 | 5/2012 | Barile |

* cited by examiner

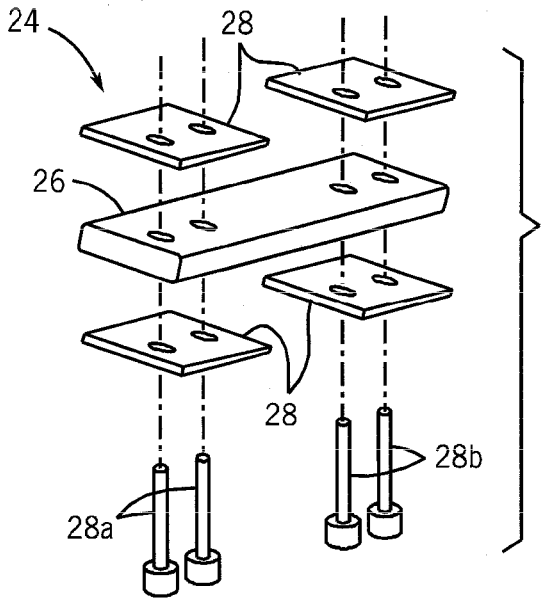
FIG. 3
FIG. 5
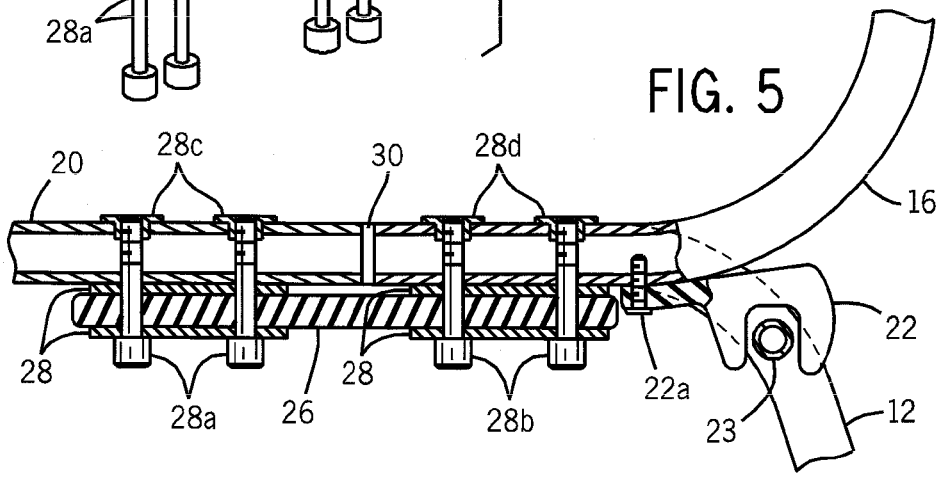
FIG. 6
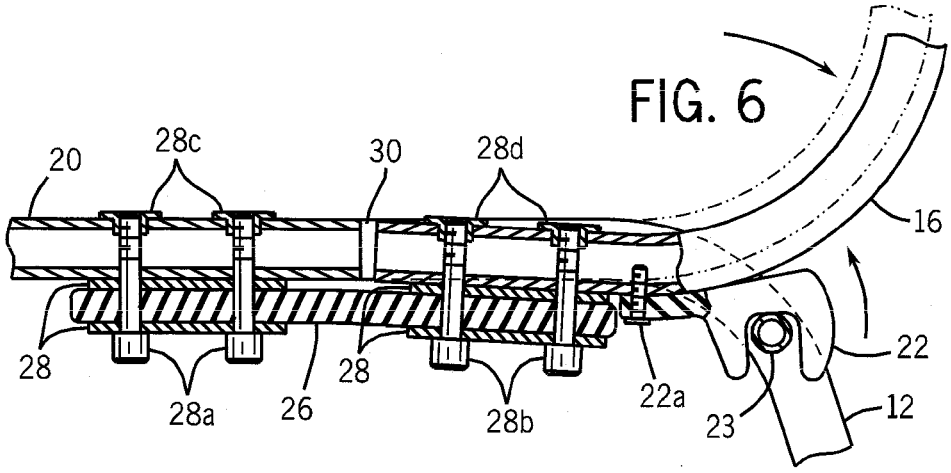

STACKABLE CHAIR WITH FLEXIBLE BACK

BACKGROUND OF THE INVENTION

The present invention relates to stackable chairs and, more particularly, to stackable chairs having a back portion that may flex to improve the comfort of the occupant.

Chairs for extended seating applications, such as banquet halls and conference rooms, are preferably comfortable, durable, and either stackable or nestable for storage purposes. Traditional stackable banquet chairs include a pair of inverted-U-shaped leg members attached to opposite sides of a generally horizontal seat. A generally L-shaped back support frame interconnects with the leg members and extends upwardly from the rear of the seat to support a back cushion. This type of chair may be stacked by placing the inverted-U-shaped leg members of one chair over the top of the leg members of another chair, such that the seat of the upper chair is supported just above the seat of the lower chair.

Numerous attempts have been made to improve the comfort level of chair occupants. For example, there have been various attempts at providing stackable chairs with flexible backs. That is, there have been designs that allow the back support portion of the chair to flex with respect to the seat cushion, thereby allowing an occupant to recline. However, such efforts have often led to complicated mechanisms that would be expensive to manufacture, or less comfortable chairs, for example chairs in which only part of the back support flexes.

As can be seen, there is a need for a simple, comfortable, and reliable chair design that may have a flexible back member and may be stackable for storage.

SUMMARY OF THE INVENTION

In one aspect of the present invention, a chair comprises a seat frame adapted to support a chair seat; a back frame adapted to support a back member; and a spring assembly connecting the seat frame to the back frame, wherein the spring assembly includes first and second plates sandwiching a flexible member at a first end of the flexible member and the spring assembly includes third and fourth plates sandwiching the flexible member a second, opposite end of the flexible member, the first and second plates and the first end of the flexible member are attached to the seat frame and the third and fourth plates and the second end of the flexible member are attached to the back frame, and the flexible member spans a gap between the seat frame and the back frame.

In another aspect of the present invention, a stackable flexible-backed chair comprises a U-shaped seat frame adapted to support a chair seat; a U-shaped back frame adapted to support a back member; and first and second spring assemblies connecting first and second ends of the U-shaped seat frame to first and second ends of the U-shaped the back frame, wherein the spring assemblies include first and second plates sandwiching a flexible member at a first end of the flexible member and the spring assembly includes third and fourth plates sandwiching the flexible member a second, opposite end of the flexible member, the first and second plates and the first end of the flexible member are attached to the seat frame and the third and fourth plates and the second end of the flexible member are attached to the back frame, the flexible member spans a gap between the seat frame and the back frame, and the spring assemblies are directly inline with a chair frame comprising the back frame and the seat frame.

These and other features, aspects and advantages of the present invention will become better understood with reference to the following drawings, description and claims.

BRIEF DESCRIPTION OF THE DRAWINGS

FIG. 3 is a detail exploded view of a back flexing mechanism of the chair of FIG. 1;

FIG. 5 is a partial cross-sectional view of a portion of the chair of FIG. 1 in a neutral position; and FIG. 6 is a partial cross-sectional view of the portion of the chair shown in FIG. 5 in a flexed position.

DETAILED DESCRIPTION OF THE INVENTION

Figure 1:
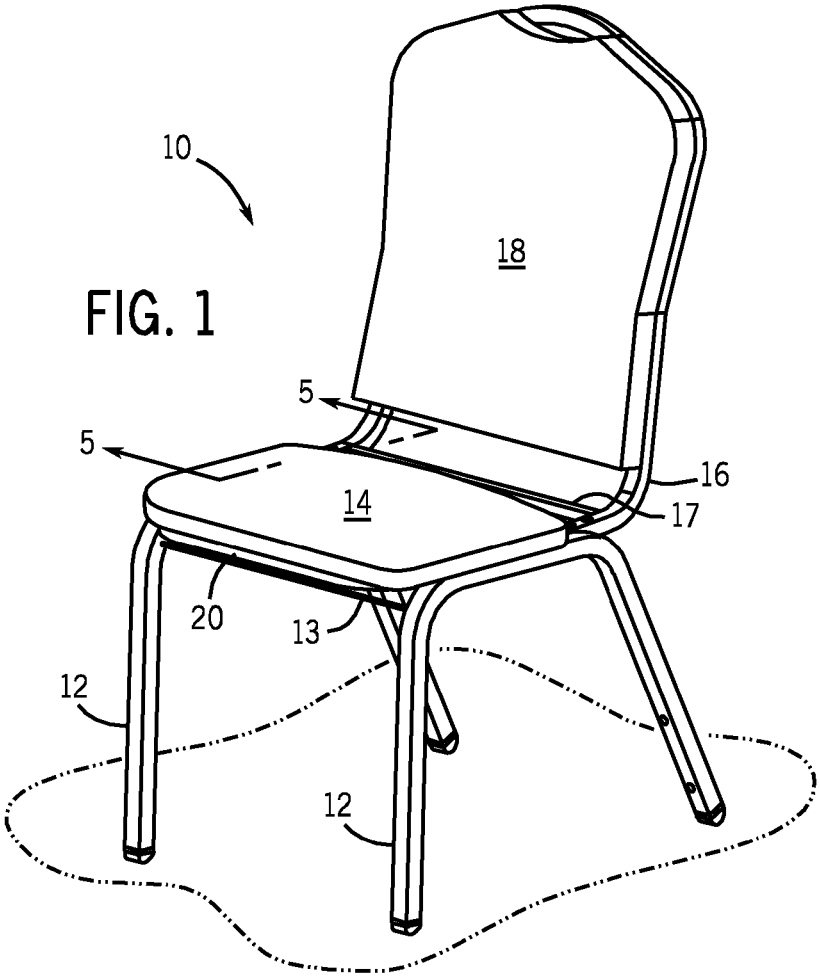
FIG. 1 is a perspective view of a chair according to an embodiment of the present invention.
Figure 4:
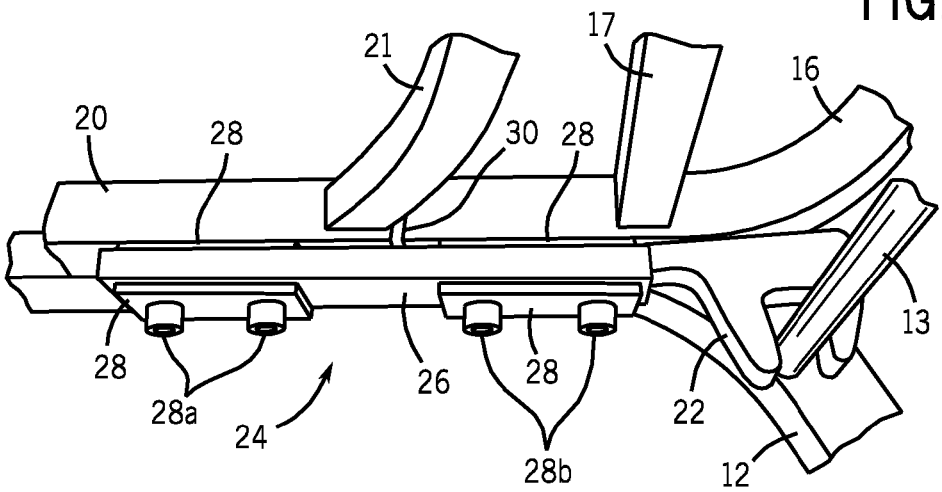
FIG. 4 is a detail perspective view of the back flexing mechanism of FIG. 3 installed on the chair of FIG. 1.
Figure 2:
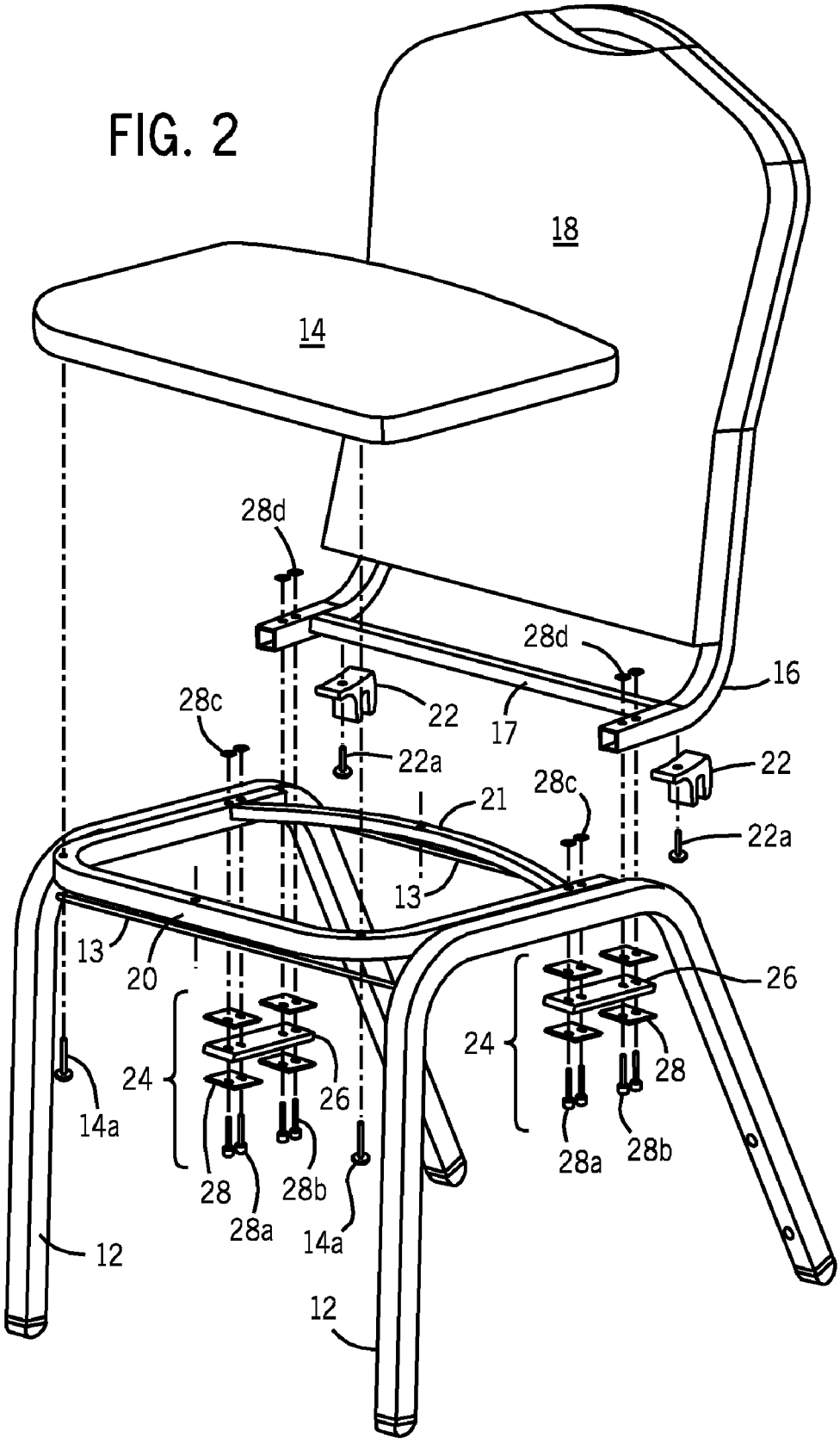
FIG. 2 is an exploded perspective view of the chair of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a stackable chair having a back member that may flex to allow for improved user comfort. Embodiments of the present invention may include an inline spring-to-frame configuration with a pair of spring members reinforced by non-welded steel plates independent of the frame on the top and bottom of each end of each spring attached to the underside of the left and right members of the seat support frame. The spring-to-frame configuration may allow the back support frame to flex relative to the seat support frame.

Unlike conventional chairs, the present invention, as described in greater detail below, may secure the spring members with steel plates on the top and bottom of each end of the spring member. The steel plates may be non-welded to any component of the chair, including the spring member, each other, and the frame itself. The steel plates may be independent of the frame, on the top and bottom of each end of each spring. The steel plate/spring member assemblies may be disposed to the underside of the left and right members of the seat support frame and the generally horizontal members of the back support frame, directly inline with the general chair frame. Conventional chairs with flexible backs may contain a seat support member, a back support member and spring member(s) that offset the springs away from left and right members of the seat support frame and the generally horizontal members of the back support frame generally towards the center of the chair, creating additional stress on the general chair frame members, resulting in a less durable design, as compared to the design of the present invention.

Unlike conventional chairs, which may include welded gussets or spring reinforcement bars, the present invention offers a simple solution, as described in greater detail below, of inline springs with non-welded steel plates, independent of the frame. Conventional chairs may experience frame fatigue by having a spring mechanism offset from the main part of the back frame and the seat frame. The chair according to embodiments of the present invention may reduce or eliminate frame fatigue due to its design.

Referring to the Figures, a chair 10 may be a stackable chair, such as a banquet chair. The chair may include a chair back 18 and a chair seat 14. The back 18 may be supported by a back frame 16. The back frame 16 may be a U-shaped tubular member. A back frame cross member 17 may connect sides of the U-shaped back frame 16. The ends of the U-shaped back frame 16 may be bent at an angle of about 50 to about 90 degrees. This angle may be selected to allow the back to attach to a seat frame 20, supporting the seat 14. The seat frame 20 may be a U-shaped tubular member. A cross member 21 may connect the sides of the U-shaped seat frame 20. The seat frame 20 may attach to leg members 12. A cross member 13 may attach the leg members 12 to each other.

The back frame 16 may connect to the seat frame 20 with a spring assembly 24. The spring assembly 24 may be disposed on each side of the ends of the U-shaped back frame 16 and the ends of the U-shaped seat frame 20. The back frame 16 and the seat frame 20 may comprise rectangular or square tubular members of approximately the same size, thereby allowing a substantially level transition between the seat frame 20 and the back frame 16 along a top surface (where the seat 14 may attach). A gap 30 may be disposed between corresponding ends of the back frame 16 and the seat frame 20. The gap 30 may be, for example from about 0.1 to about 0.8 inch.

The spring assembly 24 may include a plurality of steel plates 28 sandwiching a flexible member 26. The flexible member 26 may have first and second sets of mounting holes through which attachment means, such as first and second set of screws 28*a*, 26*b*, may pass. The first set of screws 28*a* may pass through the steel plate 28, the flexible member 26, another steel plate 28 and into the seat frame 20. The second set of screws 28*b* may pass through the steel plate 28, the flexible member 26, another steel plate 28 and into the back frame 16. The steel plates on each side of the spring (both side to side and front to back) are non-welded steel plates independent of the frame itself. The gap 30 between the back frame 16 and the seat frame 28 may permit the back frame 16 to flex relative to the seat frame 28. The screws 28*a*, 28*b* may attach into T-nuts 28*c*, 28*d* in the seat frame 20 and the back frame 16, respectively. The flexible member 26 may be directly inline with the chair frame, which includes the back frame 16 and the seat frame 20. The flexible member 26 may be, for example, a composite fiber material, strong enough to connect the back frame 16 and the seat frame 20, yet flexible enough to allow the back frame 16 to flex relative to the seat frame 20.

A stop member 22 may be attached to each leg of the back frame 16 with a screw 22*a*. The stop member 22 may be positioned to limit the distance that the back frame 16 may flex. The stop members 22 may abut a stop screw 23 when the back frame 16 flexes a predefined maximum amount. The stop members 22 may comprise a flexible material, thereby providing a flexible stop to movement of the back member 16, rather than a firm stop.

It should be understood, of course, that the foregoing relates to exemplary embodiments of the invention and that modifications may be made without departing from the spirit and scope of the invention as set forth in the following claims.

We claim:

1. A stackable chair, comprising:

a seat frame comprising at least one tubular seat frame member, said seat frame configured to receive and support a seat portion;

a back frame comprising at least one tubular back frame member, said back frame configured to receive and support a back portion;

along each side of the chair, a gap separating adjacent ends of the at least one tubular seat frame member and the at least one tubular back frame member;

at least two leg members, each of said leg members attached to said seat frame; and along each side of the chair, at least one flexible member positioned below the gap and extending across said gap, said at least one flexible member coupled to the seat frame and the back frame;

wherein the at least one flexible member is configured to selectively move between a flexed position and a non-flexed position, wherein the at least one flexible member is normally in the non-flexed position when no forces are directed on the back portion, said at least one flexible member being configured to move to a flexed position when an occupant exerts a rearwardly-directed force on the back portion to at least partially recline the back portion relative to the seat portion;

at least one first plate member positioned between the at least one flexible member and the at least one tubular seat frame member, and at least one second plate member positioned between the at least one flexible member and the at least one tubular back frame member;

wherein the at least one first plate member maintains a clearance between the flexible member and the at least one tubular seat frame member;

wherein the at least one second plate member maintains a clearance between the flexible member and the at least one tubular back frame member; and wherein a space separates adjacent ends of the at least one first plate member and the at least one second plate member, said space having a length that is greater than a length of the gap.

2. The stackable chair of claim 1, further comprising:

at least one first fastener extending through the flexible member, the at least one first plate member and the at least one seat frame member; and at least one second fastener extending through the flexible member, the at least one second plate member and the at least one back frame member.

3. The stackable chair of claim 1, wherein at least one of the at least one first plate member and the at least one second plate member comprises a steel plate.

4. The stackable chair of claim 1, further comprising at least one third plate member positioned below the at least one flexible member and the at least one tubular seat frame member.

5. The stackable chair of claim 4, wherein the at least one first plate member and the at least one third plate member are separate items.

6. The stackable chair of claim 1, further comprising at least one fourth plate member positioned below the at least one flexible member and the at least one tubular back frame member.

7. The stackable chair of claim 1, further comprising at least one stop member configured to limit an amount by which the at least one flexible member can flex.

8. A stackable chair, comprising:

a seat frame comprising at least one seat frame member, said seat frame configured to receive and support a seat portion;

a back frame comprising at least one back frame member, said back frame configured to receive and support a back portion;

along each side of the chair, a gap separating adjacent ends of the at least one seat frame member and the at least one back frame member;

at least two leg members, each of said leg members attached to said seat frame; and along each side of the chair, at least one flexible member positioned below the gap and extending across said gap, said at least one flexible member coupled to the seat frame and the back frame;

wherein the at least one flexible member is configured to selectively move between a flexed position and a non-flexed position, said at least one flexible member being configured to move from the non-flexed position to a flexed position when an occupant exerts a rearwardly-directed force on the back portion to at least partially recline the back portion relative to the seat portion;

at least one first spacer positioned between the at least one flexible member and the at least one seat frame member, and at least one second spacer positioned between the at least one flexible member and the at least one back frame member;

wherein the at least one first spacer maintains a clearance between the flexible member and the at least one seat frame member;

wherein the at least one second spacer maintains a clearance between the flexible member and the at least one back frame member; and wherein the at least one first spacer is separated from the at least one second spacer by a separation space, wherein said separation space is wider than the gap separating adjacent ends of the at least one seat frame member and the at least one back frame member.

9. The stackable chair of claim 8, wherein each of the at least one first spacer and the at least one second spacer comprises a plate.

10. The stackable chair of claim 8, further comprising:

at least one first fastener extending through the flexible member, the at least one first spacer and the at least one seat frame member; and at least one second fastener extending through the flexible member, the at least one second spacer and the at least one back frame member.

11. The stackable chair of claim 8, further comprising:

at least one third spacer positioned below the at least one flexible member and the at least one seat frame member; and at least one fourth spacer positioned below the at least one flexible member and the at least one back frame member.

12. The stackable chair of claim 11, wherein the at least one first spacer and the at least one third spacer are separate items; and wherein the at least one second spacer and the at least one fourth spacer are separate items.

13. The stackable chair of claim 11, wherein a space separates adjacent ends of the at least one third spacer and the at least one fourth spacer, said space being wider than the gap.

14. The stackable chair of claim 8, further comprising at least one stop member configured to limit an amount by which the back frame can recline relative to the seat frame.

15. A stackable chair, comprising:

a seat frame comprising at least one seat frame member, said seat frame configured to receive and support a seat portion;

a back frame comprising at least one back frame member, said back frame configured to receive and support a back portion;

along each side of the chair, a gap separating adjacent ends of the at least one seat frame member and the at least one back frame member;

at least two leg members, each of said leg members attached to said seat frame; and along each side of the chair, at least one flexible member positioned below the gap and extending across said gap, said at least one flexible member coupled to the seat frame and the back frame;

wherein the at least one flexible member is configured to selectively move between a flexed position and a non-flexed position, said at least one flexible member being configured to move from the non-flexed position to a flexed position when an occupant exerts a rearwardly-directed force on the back portion to at least partially recline the back portion relative to the seat portion;

at least one first spacer positioned between the at least one flexible member and the at least one seat frame member, at least one second spacer positioned between the at least one flexible member and the at least one back frame member;

wherein the at least one first spacer maintains a clearance between the flexible member and the at least one seat frame member;

wherein the at least one second spacer maintains a clearance between the flexible member and the at least one back frame member; and wherein the at least one first spacer and the at least one second spacer are positioned so as to create a generally open area, along an entire length of the gap, between a top of the flexible member and said gap;

at least one first fastener extending at least partially through the flexible member, the at least one first spacer and the at least one seat frame member; and at least one second fastener extending at least partially through the flexible member, the at least one second spacer and the at least one back frame member.

16. The stackable chair of claim 15, wherein the at least one first spacer comprises at least one first plate, and the at least one second spacer comprises at least one second plate.

17. The stackable chair of claim 15, wherein the at least one first fastener extends generally entirely through the flexible member, the at least one first spacer and the at least one seat frame member, and wherein the at least one second fastener extends generally entirely through the flexible member, the at least one second spacer and the at least one back frame member.

18. The stackable chair of claim 15, further comprising:

at least one third spacer positioned below the at least one flexible member and the at least one seat frame member; and at least one fourth spacer positioned below the at least one flexible member and the at least one back frame member.

19. The stackable chair of claim 18, wherein the at least one third spacer and the at least one fourth spacer are separate items; and wherein the at least one third spacer and the at least one fourth spacer are generally planar.

20. The stackable chair of claim 15, wherein the at least one first fastener and the at least one second fastener comprise bolts.

* * * * *